US008984717B1

(12) United States Patent
Jackson

(10) Patent No.: US 8,984,717 B1
(45) Date of Patent: Mar. 24, 2015

(54) FLOOR HINGE

(71) Applicant: Bommer Industries, Inc., Landrum, SC (US)

(72) Inventor: B. Stewart Jackson, Spartanburg, SC (US)

(73) Assignee: Bommer Industries, Inc., Landrum, SC (US)

( * ) Notice: Subject to any disclaimer, the term of this patent is extended or adjusted under 35 U.S.C. 154(b) by 0 days.

(21) Appl. No.: 14/286,473

(22) Filed: May 23, 2014

Related U.S. Application Data

(60) Provisional application No. 61/827,699, filed on May 27, 2013.

(51) Int. Cl.
*E05F 3/20* (2006.01)
*E05D 7/08* (2006.01)
*E05F 1/08* (2006.01)

(52) U.S. Cl.
CPC ..... *E05F 1/08* (2013.01)
USPC ..... 16/378; 16/55; 16/273

(58) Field of Classification Search
USPC ..... 16/49, 54, 55, 71, 72, 76, 286, 378, 16/273; 312/405
See application file for complete search history.

(56) References Cited

U.S. PATENT DOCUMENTS

| | | | | | |
|---|---|---|---|---|---|
| 987,467 | A * | 3/1911 | Katzenberger | 16/281 |
| 1,007,523 | A * | 10/1911 | Brucker | 16/55 |
| 1,107,708 | A * | 8/1914 | Santo | 16/55 |
| 1,518,220 | A * | 12/1924 | Petrie | 384/13 |
| 1,653,448 | A * | 12/1927 | Bommer | 16/284 |
| 2,035,823 | A * | 3/1936 | Moore | 16/284 |
| 2,603,818 | A * | 7/1952 | Carlson | 16/55 |
| 2,700,175 | A * | 1/1955 | Carlson | 16/284 |
| 3,026,559 | A * | 3/1962 | Benham | 16/284 |
| 3,032,806 | A * | 5/1962 | Mallory | 16/66 |
| 3,072,954 | A * | 1/1963 | Patriquin | 16/66 |
| 3,335,451 | A * | 8/1967 | Patriquin | 16/52 |
| 3,702,015 | A * | 11/1972 | Blom | 16/55 |
| 3,724,023 | A * | 4/1973 | Tillmann | 16/53 |
| 2008/0127452 | A1 * | 6/2008 | Jackson | 16/50 |
| 2010/0024159 | A1 * | 2/2010 | Oh et al. | 16/54 |

* cited by examiner

*Primary Examiner* — Chuck Mah
(74) *Attorney, Agent, or Firm* — J. M. Robertson, LLC

(57) ABSTRACT

A self-returning hinge assembly utilizing a spring disposed along a linearly displaceable guide shaft element mounted through a polymeric guide plate disposed in substantial alignment with an aperture supporting an elongated proximal portion of the guide shaft. Upon displacement of the door from a pre-established set point, the spring is compressed thereby generating a biasing force along the guide shaft to bring the door back to the pre-established set point. The linear travel path of the guide shaft element is maintained by the guide plate.

12 Claims, 5 Drawing Sheets

FLOOR HINGE

CROSS-REFERENCE TO RELATED APPLICATIONS

This non-provisional application claims the benefit of, and priority from U.S. provisional application 61/827,699 filed May 27, 2013. The contents of such prior application and all documents referenced herein are hereby incorporated by reference in their entirety as if fully set forth herein.

TECHNICAL FIELD

This disclosure relates to a self-returning hinge assembly mounted between a support floor and a door. More particularly, the disclosure relates to a self-returning hinge assembly mounted between a support floor and a door utilizing a spring disposed along a linearly displaceable guide shaft element mounted through a supporting guide plate. Upon displacement of the door from a pre-established set point, the spring is compressed thereby generating a biasing force along the guide shaft to bring the door back to the pre-established set point. The linear travel path of the guide shaft element is maintained by the guide plate.

BACKGROUND

Floor hinges are well known. As will be appreciated by those of skill in the art, such hinges typically use a base plate assembly that is bolted or otherwise mounted to the floor so as to remain substantially static. Such hinges also typically include a displaceable frame structure mounted to the door and operatively connected to the base plate assembly. Thus, when the door is moved, there is a relative movement between the frame structure and the base plate assembly. Self returning floor hinges using a spring biased return are also well known. One exemplary spring biased floor hinge is the Model 7811 spring pivot marketed by Bommer Industries, Inc. having a place of business in Landrum, S.C. Such spring biased floor hinges incorporate a spring disposed along a linearly displaceable guide shaft element mounted within the displaceable frame structure. Upon displacement of the door from a pre-established set point, a cam-follower attached to the guide shaft is displaced thereby moving the guide shaft in a linear manner and compressing the spring. The spring compression generates a biasing force along the guide shaft to bring the door back to the pre-established set point. In such prior floor hinges, the linear travel of the guide shaft is maintained by alignment pins extending transverse to the guide shaft and projecting through guide slots in plates above and below the guide shaft. By constraining the pins within the guide slots, the operatively connected guide shaft is thereby limited to substantially linear travel in line with the guide slots as the cam follower is displaced.

Another exemplary spring biased floor hinge is illustrated and described in US patent application 2008/0127452A1 (incorporated by reference). This construction replaces the alignment pins of the Model 7811 with a generally "H" shaped guide plate of hardened steel or the like with a central aperture supporting the guide shaft.

While the prior constructions of self returning floor hinges have performed quite well, the prior products incorporate metal guide plates or pin elements and guide slots to maintain consistent repeatable linear travel. Due to the large number of use cycles that these parts experience, the practice has been to use components of substantial cross-sectional dimension in combination with a relatively heavy cam follower body.

Moreover, it has been found that over extended periods of time, the guide slots may tend to experience a degree of wear that varies over the length of the guide slots. This variable wear may give rise to a noticeable clicking sound over the life of the product. Moreover, the use of an "H" shaped guide plate of hardened steel or the like may be difficult to maintain in proper alignment and may impart enhanced wear to a guide shaft during prolonged use.

SUMMARY OF THE DISCLOSURE

The present disclosure provides advantages and alternatives over the prior art by providing a self-returning hinge assembly mounted between a support floor and a door utilizing a spring disposed along a linearly displaceable guide shaft element mounted through a polymeric guide plate disposed in substantial alignment with an aperture supporting an elongated proximal portion of the guide shaft. Upon displacement of the door from a pre-established set point, the spring is compressed thereby generating a biasing force along the guide shaft to bring the door back to the pre-established set point. The linear travel path of the guide shaft element is maintained by the guide plate. The guide plate may be mounted at two opposing points on a surrounding frame and bushings may be present at either end of the spring for disposition in sandwich relation between the spring and the guide shaft element.

In accordance with one exemplary aspect, the present disclosure provides a self returning floor mounted hinge assembly for a door. The hinge assembly includes a base plate adapted for stationary mounting to a floor or other support structure and a bearing cam assembly secured in substantially fixed relation to the base plate. The bearing cam assembly includes a pair of spaced apart roller elements. A frame structure including an upper bracket and a lower bracket is adapted to be mounted to the door in rotatable relation to the bearing cam assembly. The hinge assembly further includes a guide shaft having a proximal end projecting away from the bearing cam assembly. The proximal end is supported in sliding relation within a shaft opening in the frame structure. The guide shaft further includes a distal end of reduced diameter relative to the proximal end. The distal end projects towards the bearing cam assembly and is operatively connected to a cam follower thrust lug having an angled face operatively engaging the roller elements. A coil spring is disposed in surrounding relation to the guide shaft such that the guide shaft is slideable through the coil spring. A collar is held in fixed relation relative to the guide shaft at a position between the thrust lug and the coil spring. A first polymeric bushing and a second polymeric bushing are disposed in surrounding relation to the guide shaft at opposing ends of the coil spring. The first polymeric bushing and the second polymeric bushing each have a nipple segment disposed in sandwiched relation between the coil spring and the exterior of the guide shaft. The first polymeric bushing includes a first platform segment disposed between the collar and the coil spring in opposing, contacting relation to a first end of the coil spring and the second polymeric bushing includes a second platform segment disposed between the shaft opening and the coil spring in opposing, contacting relation to a second end of the coil spring such that the coil spring is held between the first platform segment and the second platform segment. Upon axial movement of the guide shaft away from the bearing cam assembly, the coil spring is compressed between the first platform segment and the second platform segment. A polymeric guide plate is held in inserted relation between the upper bracket and the lower bracket at a position between the collar and the cam follower thrust lug such that the guide shaft is supported in sliding relation by the guide plate. The guide plate includes a plate body surrounding an acceptance opening axially aligned with the shaft opening in the frame structure and adapted to slidingly support the guide shaft. The guide plate further includes a pair of opposing perimeter ears adapted for insertion through enclosed slots in the upper and lower brackets such that the guide plate is supported at two opposing points.

It is to be understood that other aspects, advantages, and features of the disclosure will become apparent through a reading of the following detailed description of the disclosure and/or through use of the described embodiments. Accordingly, such description is to be understood to be exemplary and explanatory only and in no event is the disclosure to be limited to any illustrated and described embodiments. On the contrary, it is intended that the present disclosure shall extend to all alternatives and modifications as may embrace the principals of this disclosure within the true spirit and scope thereof.

BRIEF DESCRIPTION OF THE DRAWINGS

Exemplary embodiments of the present disclosure will now be described by way of example only, with reference to the accompanying drawings which are incorporated in and which constitute a part of this specification herein and together with the general description given above, and the detailed description set forth below, serve to explain the principles of the disclosure wherein.

Figure 1:
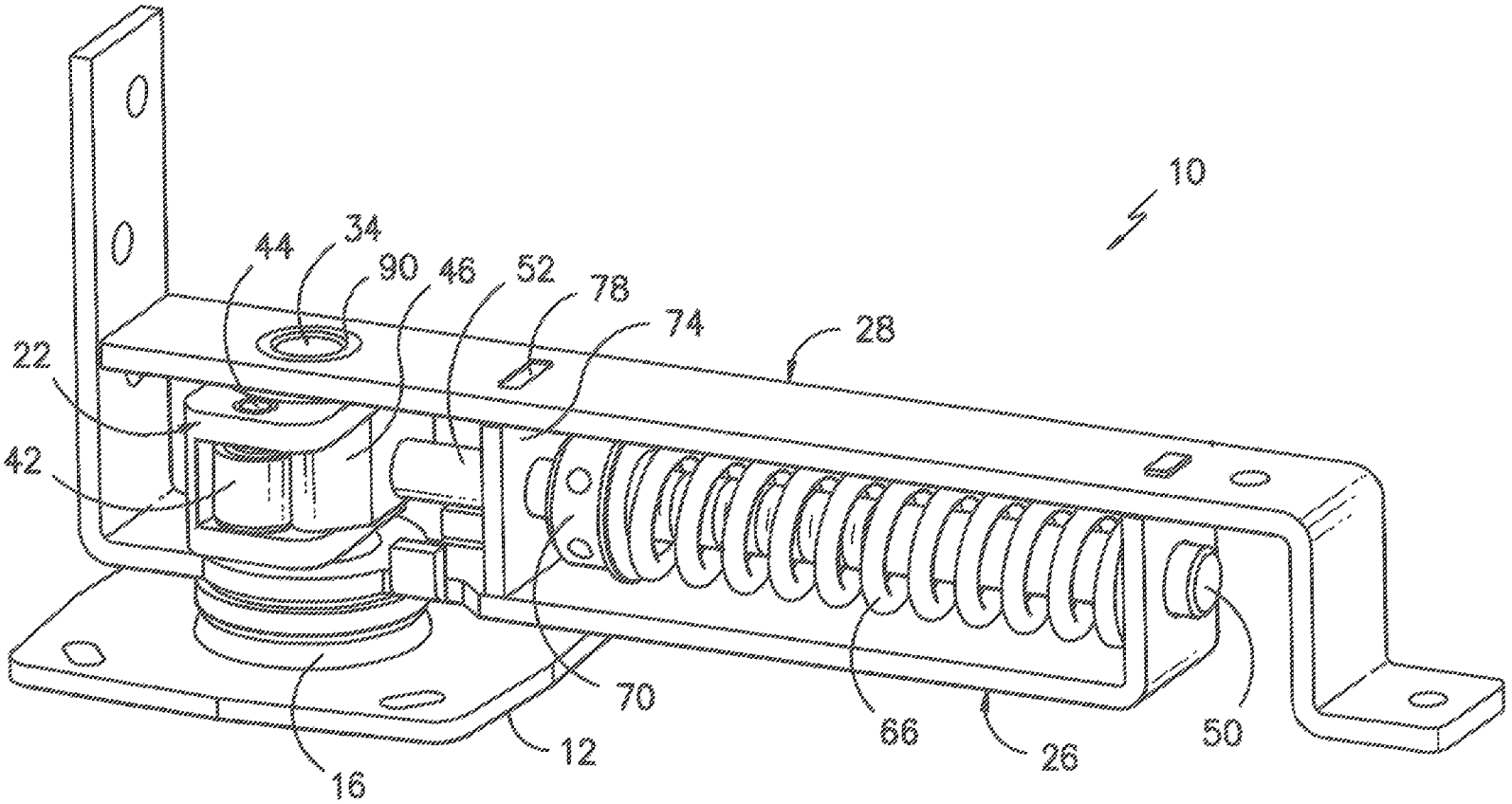
FIG. 1 is a schematic perspective view of a floor hinge consistent with the present disclosure.

Before the exemplary embodiments are explained in detail, it is to be understood that the invention is in no way limited in its application or construction to the details and the arrangements of the components set forth in the following description or illustrated in the drawings. Rather, the invention is capable of other embodiments and of being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION

Reference will now be made to the drawings, wherein, to the extent possible, like elements are designated by like reference numerals in the various views. Referring now to FIG. 1, an exemplary hinge assembly 10 is illustrated. As shown, the hinge assembly 10 utilizes a base plate 12 which may be mounted in substantially fixed relation to the floor or other support surface. A bearing race 16 is secured to the base plate 12 and houses a bearing (not shown) such as a nylon ring bearing or the like. The base plate 12 and the bearing race 16 are adapted to accept and retain a key post projecting downwardly from a bearing cam assembly 22 in a manner as will be well known to those of skill in the art such that the bearing cam assembly 22 is held in substantially fixed relation relative to the base plate 12. Thus, the bearing cam assembly is held stationary relative to the floor or other support surface.

Figure 4:
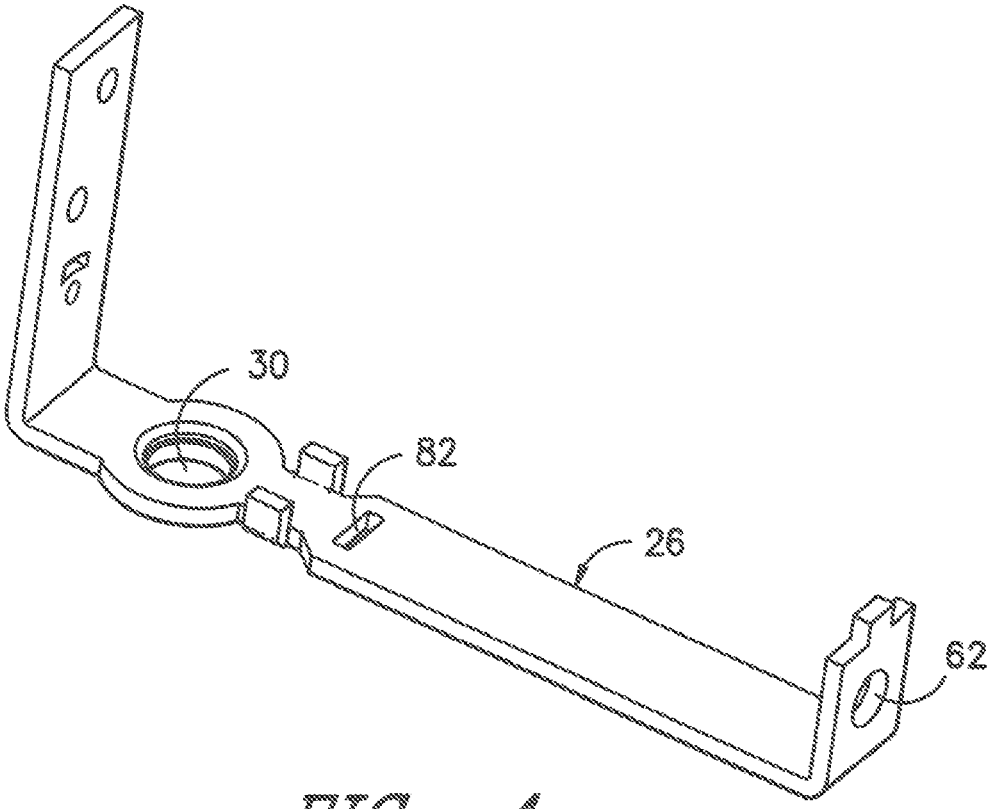
FIG. 4 is a schematic perspective view of a lower frame member used in the floor hinge of FIG. 1.
Figure 5:
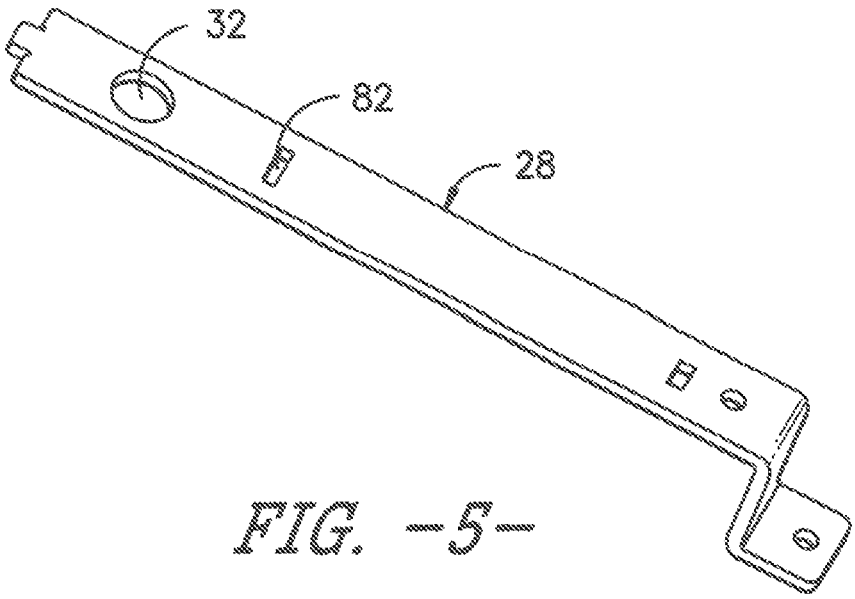
FIG. 5 is a schematic perspective view of an upper frame member used in the floor hinge of FIG. 1.

In the illustrated construction, the hinge assembly 10 includes a frame structure formed from a first or lower bracket 26 (FIG. 4) and a second or upper bracket 28 (FIG. 5). As best seen in FIG. 4, the lower bracket 26 includes a lower bracket opening 30 sized to accept the key post projecting downwardly from the bearing cam assembly 22 without obstruction. The upper bracket 28 likewise includes an upper bracket opening 32 sized to accept a pin 34 projecting upwardly from the bearing cam assembly 22.

Figure 2:
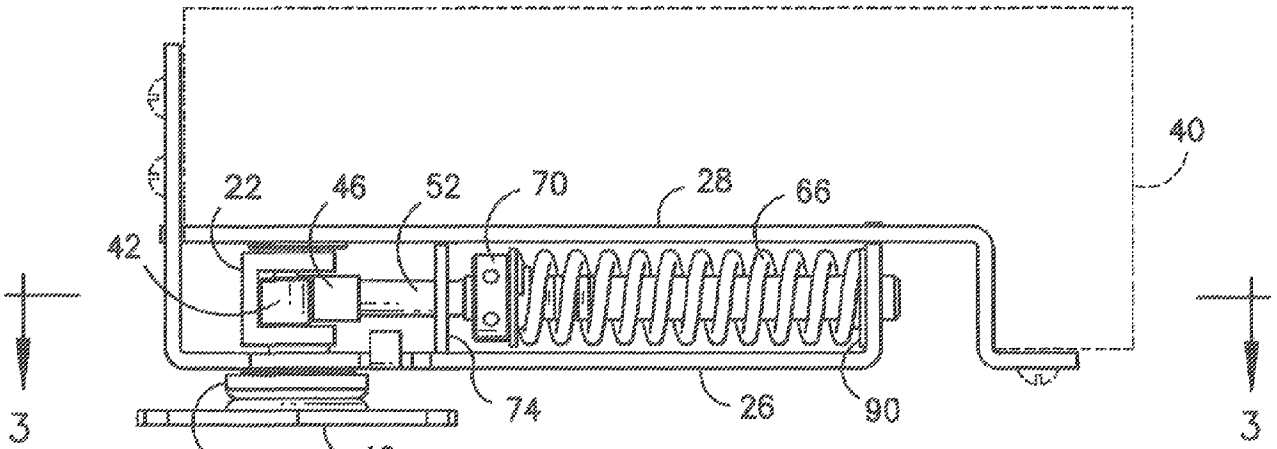
FIG. 2 is a side view of the floor hinge of FIG. 1.

As will be readily appreciated by those of skill in the art, when the bearing cam assembly 22 is fixed in position relative to the base plate 12, the upper and lower brackets may rotate around the bearing cam assembly 22 with an axis of rotation disposed in coaxial relation to the pin 34. As shown in FIG. 2, the upper and lower brackets 26, 28 may be mounted in substantially fixed relation at a lower inner corner of a door 40 by screws, bolts or other appropriate fixation devices. Thus, as the door 40 is rotated, the upper and lower brackets 26, 28 move in concert with the door 40 while the bearing cam assembly 22 remains held in place by the base plate 12.

As shown, the bearing cam assembly 22 preferably includes a pair of low friction rollers 42 of nylon or other polymeric material incorporating a wear activated lubricant such as graphite or the like as will be known to those of skill in the art. The rollers 42 are held in place by roller pins 44 on opposite sides of the axis defined by the pin 34 such that they are substantially free to rotate. In the assembled state, the rollers 42 engage a cam follower thrust lug 46 which is preferably formed from the same material as the rollers 42 so as to minimize friction. According to one exemplary construction, the thrust lug 46 may be substantially trapezoidal in shape and may incorporate a centrally disposed scalloped face depression 48 extending along the full height of the thrust lug at a roller engagement face 49 adapted to engage the rollers 42.

Figure 7:
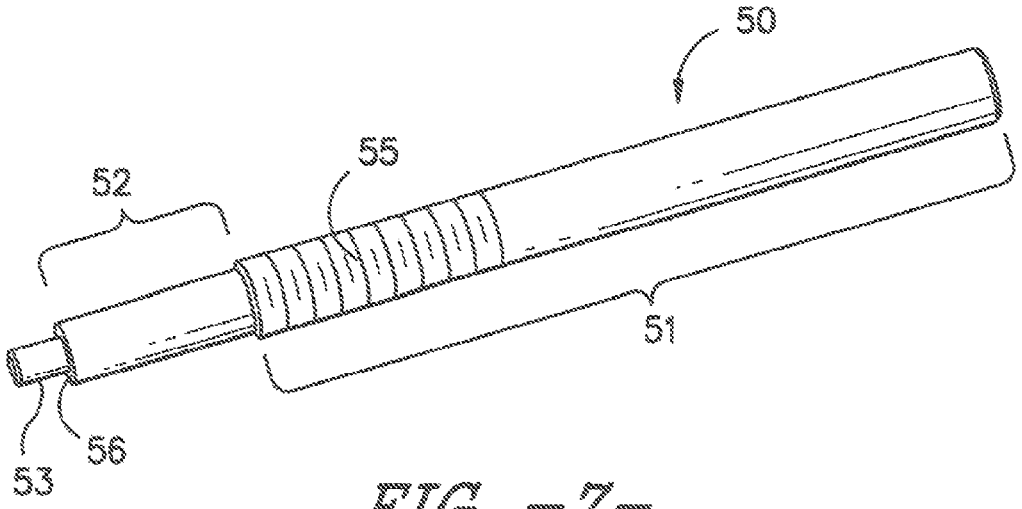
FIG. 7 is a schematic perspective view of an exemplary guide shaft used in the floor hinge of FIG. 1.
Figure 9:
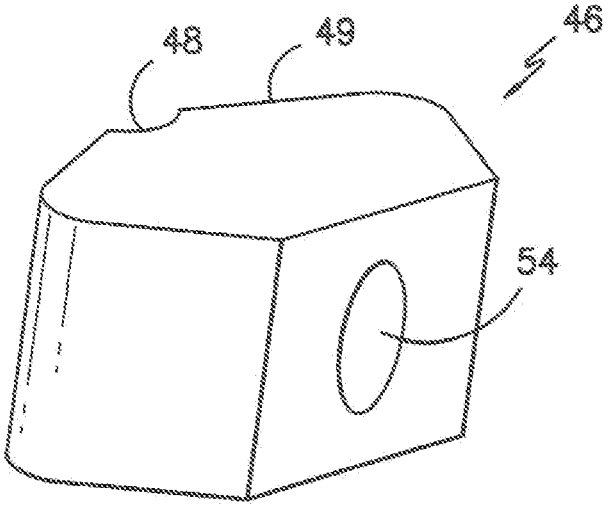
FIG. 9 is a schematic perspective view of an exemplary thrust lug used in the floor hinge of FIG. 1.

In the illustrated exemplary construction, the thrust lug 46 is affixed at a distal end of a guide shaft 50 of carburized steel or like structural material (FIG. 7). As best illustrated through reference to FIGS. 3 and 7, the guide shaft 50 may incorporate a stepped construction including a main body portion 51 which steps down to an adjacent reduced diameter intermediate segment 52 of reduced diameter. The intermediate segment 52, in turn, steps down to a nipple segment 53 of reduced diameter relative to the intermediate segment. As best understood through joint reference to FIGS. 3, 7 and 9, the nipple segment 53 may be held by press-fit insertion within a lug opening 54 at the rear face of the thrust lug 46 facing away from the roller engagement face 49. In this assembled condition, the rear face may abut a substantially flat step 56 at the intersection between the intermediate segment 52 and the distal nipple segment 53. According to one exemplary practice, the compression force of the thrust lug 46 may hold the distal nipple segment 53 in place without additional joining mechanisms. As illustrated, the exemplary guide shaft 50 may further include a threaded segment 55 disposed along the main body portion 51 in adjacent relation to the intermediate segment 52.

Figure 3:
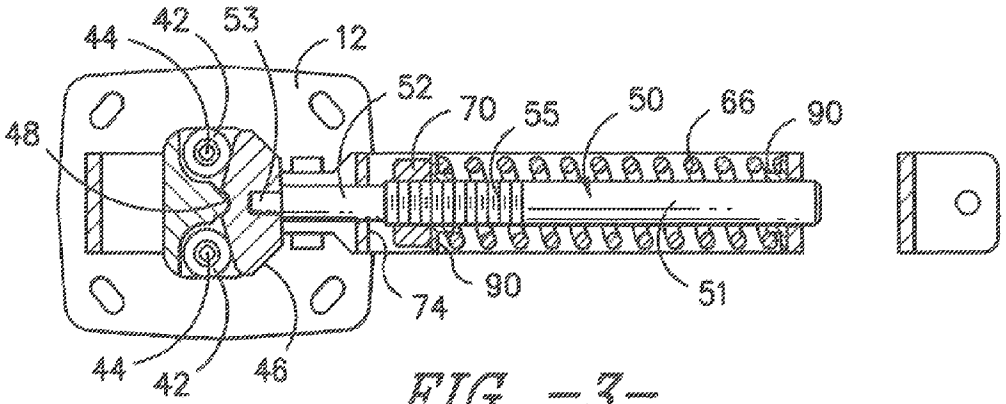
FIG. 3 is a sectional view of a floor hinge of FIG. 1 taken generally along line 3-3 in FIG. 2.

As best seen in FIGS. 1-3, the proximal end of the guide shaft 50 opposing the thrust lug 46 may be held within a shaft opening 62 in an upwardly extending leg portion of the lower bracket 26. A coil spring 66 is disposed in surrounding relation to the main body portion 51 of the guide shaft 50 such that the guide shaft 50 may slide freely within the coil spring 66. In the assembled state, the coil spring 66 is held in compression in the region between an adjustable collar 70 and the upwardly extending leg portion of the lower bracket 26. In the illustrated exemplary construction, tensioning adjustments may be made by simply changing the position of collar 70 along the guide shaft 50 using engagement between the collar 70 and the threaded segment 55 whereby the collar 70 may be advanced to variable positions along the threaded segment. Once the tensioning set point is fixed, axial stroke movement of the guide shaft 50 through the coil spring 66 and the shaft opening 62 further compresses the coil spring 66 and generates a return biasing force as the spring seeks to relieve the increased applied compression.

In the illustrated exemplary construction, the guide shaft 50 is supported in sliding relation at its distal end by a polymeric guide plate 74 of nylon or like material. If desired, the guide plate 74 may be infused with a wear-activated lubricant such as graphite or the like to reduce friction. As illustrated, the guide plate 74 surrounds the reduced diameter intermediate segment 52 of the guide shaft 50 at a position between the thrust lug 46 and the collar 70.

Figure 6:
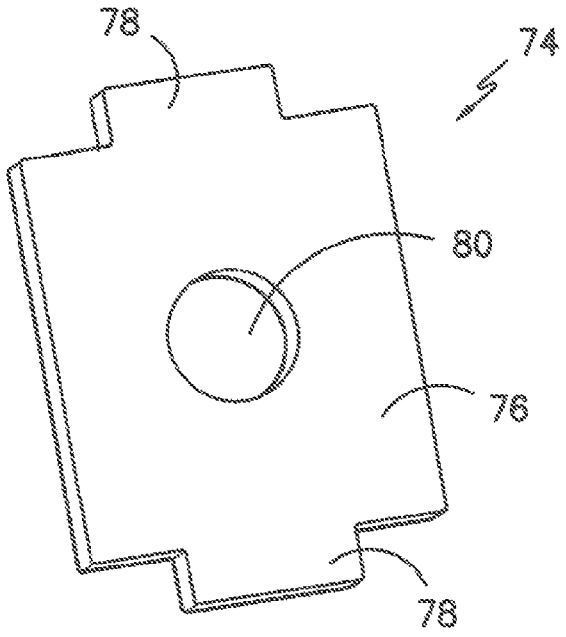
FIG. 6 is a schematic perspective view of an exemplary guide plate used in the floor hinge of FIG. 1.

As best seen in FIG. 6, in the exemplary construction, the guide plate 74 is of unitary construction with substantially uniform thickness incorporating a rectangular plate body 76 with a pair of outwardly projecting rectangular perimeter ears 78 extending away from opposing sides of the plate body 76 in substantially mirror image relation to one another. Thus, the plate body 76 and the perimeter ears 78 cooperatively define a cross-shaped perimeter. An acceptance opening 80 is disposed substantially centrally within the plate body 76. The acceptance opening 80 within the guide plate 74 is preferably sized so as to permit the intermediate segment 52 of the guide shaft to slide freely through the opening while maintaining a close fitted relation thereby holding the shaft substantially straight during axial movement. Thus, the guide shaft 50 is supported between the upwardly extending leg of the lower bracket 26 and the guide plate 74.

As best seen through joint reference to FIGS. 4-6, the lower bracket 26 and the upper bracket 28 each incorporate an enclosed ear acceptance slot 82, extending partially across the width dimensions of the respective brackets. As seen in FIG. 1, the ear acceptance slots 82 are each adapted to receive and retain a perimeter ear 78 of the guide plate 74 in sliding fit relation. This engagement between the perimeter ears 78 and the upper and lower brackets 26, 28 is used to secure the guide plate 74 in place using only the engagement provided by the perimeter ears at the interior of the brackets. Surprisingly, it has been found that the illustrated two point engagement in combination with the polymeric guide plate provides a secure and durable connection for the guide plate 74 while also providing adequate support for the guide shaft.

Figure 8:
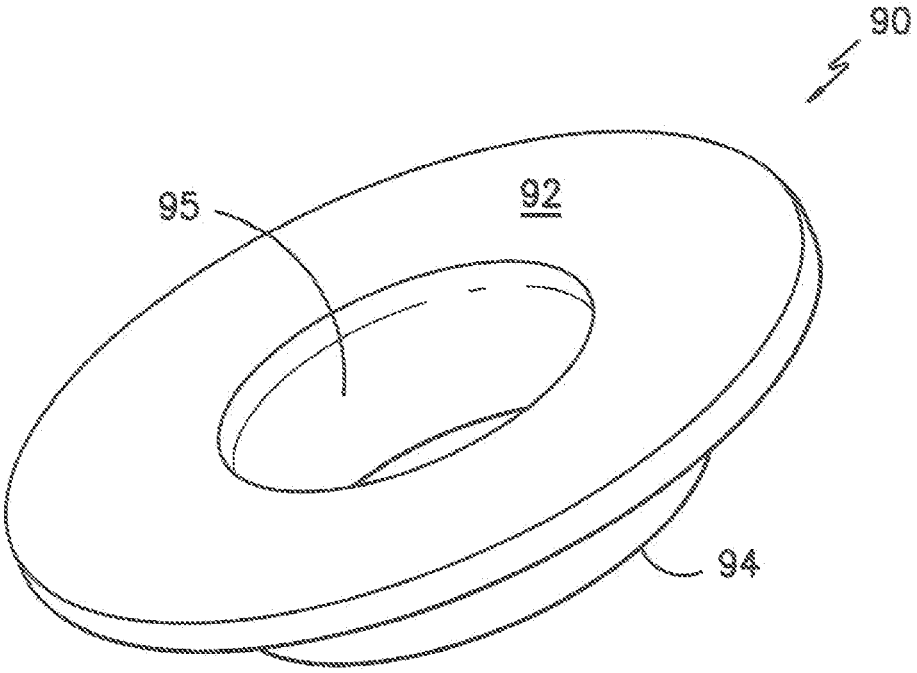
FIG. 8 is a schematic perspective view of an exemplary polymeric bushing used in the floor hinge of FIG. 1.

Referring now to FIGS. 2, 3 and 8, it may be seen that in the illustrated exemplary construction a pair of bushings 90 are disposed along the guide shaft 50 adjacent either end of the coil spring 66. The bushings 90 may be formed from a polymeric material such as nylon or the like. If desired, the bushings may be infused with a wear activated lubricant such as graphite or the like to reduce friction. As best seen in FIG. 8, each of the bushings may be of generally annular configuration incorporating a generally disk-shaped platform 92 and a reduced diameter nipple 94 extending downwardly from the platform 92 in substantially coaxial relation to the platform. A substantially uniform diameter through channel 95 extends through the bushings 90, such that the bushings are hollow along their length. As best seen in FIG. 2, in the exemplary construction, the bushings 90 extend in sleeve-fitting relation about the guide shaft 50 such that at each end of the coil spring 66, a nipple 94 of a bushing is disposed in sandwiched relation between the inner surface of the coil spring 66 and the outer surface of the main body portion 51 of the guide shaft 50. In this condition, a platform segment 92 of a bushing 90 abuts against each end of the coil spring 66. Accordingly, a first one of the bushings 90 defines a barrier between a first end of the coil spring 66 and the collar 70 and a second one of the bushings 90 defines a barrier between a second end of the coil spring 66 and the upwardly extending leg of the lower bracket 26. Nonetheless, the guide shaft 50 is able to slide axially within the through channels 95 in the bushings 90 substantially without restriction.

As best seen in FIG. 1, a bushing 90 as shown in FIG. 8 may also be disposed in the upper bracket opening 32 in surrounding relation to the pin 34 projecting upwardly from the bearing cam assembly 22. As will be appreciated, this arrangement reduces friction and wear between the pin 34 and the upper bracket 28.

As noted previously, during operation the bearing cam assembly 22 is held in fixed relation by its connection to the base plate 12 while the frame structure with the attached guide shaft 50, thrust lug 46, coil spring 66 and guide plate 74 move with the door 40. As the door 40 is opened, the face 49 of the thrust lug 46 rides over the surface of the rollers 42. As surfaces of the thrust lug outboard of the face depression 48 ride over a contacting roller 42, the thrust lug and attached guide shaft 50 are progressively pushed away from the bearing cam assembly 22. This action translates to axial movement of attached guide shaft 50 in a path defined by the axis running between the acceptance opening 80 in the guide plate 74 and shaft opening 62 in the upwardly extending leg portion of the lower bracket 26. The axial movement away from the bearing cam assembly 22 in turn causes compression of the coil spring 66 between the two opposing bushings 90. In the illustrated construction incorporating a face depression 48 at a central portion of the thrust lug, continued rotation eventually causes the point of contact between the thrust lug and the roller to move into the zone occupied by the face depression 48 such that the roller drops into the depression. With the roller 42 disposed within the face depression 48, the door 40 will remain ajar until a return rotational force is applied by an operator forcing the roller back onto the sloped face. Thus, the illustrated construction permits the door to be moved through a substantial angle with self biasing return over the interior portion of the angle and with the ability to hold the door open at the angle extremes. Of course, the use of a face depression on the thrust lug is optional. By way of example only, in the event that a face depression is not utilized, the thrust lug may simply use a face which tapers to an apex at the center. As will be appreciated, in such a construction the hinge will be self returning over substantially its full range of motion.

Regardless of the thrust lug construction which may be utilized, it has been found that the utilization of a polymeric guide plate 74 with a cross-shaped perimeter in combination with bushings 90 disposed between the coil spring 66 and the guide shaft 50 provides excellent support and wear resistance over a large number of cycles. In particular, such a construction has been tested to over 2 million cycles without failure thereby reflecting significant improvements over prior known constructions despite the use of a cross-shaped polymeric guide plate which would be expected to degrade and lose support more rapidly than prior metal support structures.

Of course, variations and modifications of the foregoing are within the scope of the present disclosure. Thus, it is to be understood that the disclosure disclosed and defined herein extends to all alternative combinations of two or more of the individual features mentioned or evident from the text and/or drawings. All of these different combinations constitute various alternative aspects of the present disclosure.

What is claimed is:

1. A self returning floor mounted hinge assembly for a door, the hinge assembly comprising:

a base plate adapted for stationary mounting to a support structure;

a bearing cam assembly secured in substantially fixed relation to the base plate, wherein the bearing cam assembly includes a pair of spaced apart roller elements;

a frame structure adapted to be mounted to the door and rotatably connected to the bearing cam assembly, the frame structure having an upper bracket and a lower bracket;

a guide shaft having a proximal end projecting away from the bearing cam assembly, the proximal end being supported in sliding relation within a shaft opening in the frame structure, the guide shaft having a distal end of reduced diameter relative to the proximal end, the distal end projecting towards the bearing cam assembly, said distal end being operatively connected to a cam follower thrust lug having an angled face operatively engaging the roller elements;

a coil spring disposed in surrounding relation to the guide shaft such that the guide shaft is slideable through the coil spring;

a collar held in fixed relation relative to the guide shaft at a position between the thrust lug and the coil spring;

a first polymeric bushing and a second polymeric bushing, the first polymeric bushing and the second polymeric bushing each being hollow along their length and being disposed in surrounding relation to the guide shaft at opposing ends of the coil spring, the first polymeric bushing and the second polymeric bushing each having a nipple segment disposed in sandwiched relation between the coil spring and the exterior of the guide shaft, the first polymeric bushing having a first platform segment disposed between the collar and the coil spring in opposing, contacting relation to a first end of the coil spring and the second polymeric bushing having a second platform segment disposed between the shaft opening and the coil spring in opposing, contacting relation to a second end of the coil spring such that the coil spring is held between the first platform segment and the second platform segment and upon axial movement of the guide shaft away from the bearing cam assembly, the coil spring is compressed in a region between the first platform segment and the second platform segment; and a polymeric guide plate held in inserted relation between the upper bracket and the lower bracket at a position between the collar and the cam follower thrust lug such that the guide shaft is supported in sliding relation by the guide plate, the guide plate including a plate body surrounding an acceptance opening axially aligned with the shaft opening in the frame structure and adapted to slidingly support the guide shaft, the guide plate further including a pair of opposing perimeter ears adapted for insertion through enclosed slots in the upper and lower brackets such that the guide plate is supported at only two points.

2. The hinge assembly as recited in claim 1, wherein the first polymeric bushing and the second polymeric bushing are made of nylon.

3. The hinge assembly as recited in claim 1, further comprising a third polymeric bushing disposed on surrounding relation to a pin projecting away from the bearing cam assembly and disposed in mating relation within an opening in the upper bracket.

4. The hinge assembly as recited in claim 3, wherein the third polymeric bushing is made of nylon.

5. The hinge assembly as recited in claim 1, wherein the guide plate is made of nylon.

6. The hinge assembly as recited in claim 1, wherein the guide shaft is of stepped construction comprising a main body portion having a first diameter, an intermediate segment having a second diameter which is less than the first diameter and a distal nipple segment having a third diameter which is less than the second diameter, the intermediate segment having a length greater than the distal nipple segment and being disposed between the main body portion and the distal nipple segment.

7. The hinge assembly as recited in claim 6, wherein the coil spring is disposed in surrounding relation to the main body portion and the guide plate is disposed in surrounding relation to the intermediate segment.

8. The hinge assembly as recited in claim 7, wherein the distal nipple segment is held in friction fit relation within an opening in the thrust lug.

9. A self returning floor mounted hinge assembly for a door, the hinge assembly comprising:

a base plate adapted for stationary mounting to a support structure;

a bearing cam assembly secured in substantially fixed relation to the base plate, wherein the bearing cam assembly includes a pair of spaced apart roller elements;

a frame structure adapted to be mounted to the door and rotatably connected to the bearing cam assembly, the frame structure having an upper bracket and a lower bracket;

a guide shaft having a proximal end projecting away from the bearing cam assembly, the proximal end being supported in sliding relation within a shaft opening in the frame structure, the guide shaft having a distal end of reduced diameter relative to the proximal end, the distal end projecting towards the bearing cam assembly, said distal end being operatively connected to a cam follower thrust lug having an angled face operatively engaging the roller elements;

a coil spring disposed in surrounding relation to the guide shaft such that the guide shaft is slideable through the coil spring;

a collar held in fixed relation relative to the guide shaft at a position between the thrust lug and the coil spring;

a first nylon bushing and a second nylon bushing, the first nylon bushing and the second nylon bushing each being hollow along their length and being disposed in surrounding relation to the guide shaft at opposing ends of the coil spring, the first nylon bushing and the second nylon bushing each having a nipple segment disposed in sandwiched relation between the coil spring and the exterior of the guide shaft, the first nylon bushing having a first platform segment disposed between the collar and the coil spring in opposing, contacting relation to a first end of the coil spring and the second nylon bushing having a second platform segment disposed between the shaft opening and the coil spring in opposing, contacting relation to a second end of the coil spring such that the coil spring is held between the first platform segment and the second platform segment and upon axial movement of the guide shaft away from the bearing cam assembly, the coil spring is compressed in a region between the first platform segment and the second platform segment; and a nylon guide plate held in inserted relation between the upper bracket and the lower bracket at a position between the collar and the cam follower thrust lug such that the guide shaft is supported in sliding relation by the guide plate, the guide plate including a plate body surrounding an acceptance opening axially aligned with the shaft opening in the frame structure and adapted to slidingly support the guide shaft, the guide plate further including a pair of opposing perimeter ears adapted for insertion through enclosed slots in the upper and lower brackets such that the guide plate is supported at only two points, wherein the guide shaft is of stepped construction comprising a main body portion having a first diameter, an intermediate segment having a second diameter which is less than the first diameter and a distal nipple segment having a third diameter which is less than the second diameter, the intermediate segment having a length greater than the distal nipple segment and being disposed between the main body portion and the distal nipple segment, the coil spring being disposed in surrounding relation to the main body portion and the guide plate being disposed in surrounding relation to the intermediate segment.

10. The hinge assembly as recited in claim 9, further comprising a polymeric bushing disposed on surrounding relation to a pin projecting away from the bearing cam assembly and disposed in mating relation within an opening in the upper bracket.

11. The hinge assembly as recited in claim 10, wherein the polymeric bushing is made of nylon.

12. The hinge assembly as recited in claim 11, wherein the distal nipple segment is held in friction fit relation within an opening in the thrust lug.

* * * * *